United States Patent [19]

Datta

[11] 4,054,471

[45] Oct. 18, 1977

[54] PROCESSING FOR CUBE-ON-EDGE ORIENTED SILICON STEEL

[75] Inventor: Amitava Datta, Pittsburgh, Pa.

[73] Assignee: Allegheny Ludlum Industries, Inc., Pittsburgh, Pa.

[21] Appl. No.: 696,964

[22] Filed: June 17, 1976

[51] Int. Cl.[2] ..... H01F 1/04

[52] U.S. Cl. ..... 148/112; 75/123 L; 148/113

[58] Field of Search ..... 148/112, 111, 113, 31.55; 75/123 L

[56] References Cited

U.S. PATENT DOCUMENTS

| | | | |
|---|---|---|---|
| 2,534,141 | 12/1950 | Morrill et al. | 148/111 |
| 2,875,113 | 2/1959 | Fitz | 148/113 |
| 3,855,021 | 12/1974 | Salsgiver et al. | 148/112 |
| 3,905,843 | 9/1975 | Fiedler | 148/111 |
| 3,954,521 | 5/1976 | Malagari | 148/111 |

*Primary Examiner*—Walter R. Satterfield

*Attorney, Agent, or Firm*—Vincent G. Gioia; Robert F. Dropkin

[57] ABSTRACT

A process for producing electromagnetic silicon steel having a cube-on-edge orientation and a permeability of at least 1870 ($G/O_e$) at 10 oersteds. The process includes the steps of: preparing a melt of silicon steel containing from 0.02 to 0.06% carbon, from 0.0006 to 0.0080% boron, up to 0.0100% nitrogen, no more than 0.008% aluminum and from 2.5 to 4.0% silicon; casting said steel; hot rolling said steel; cold rolling said steel to a thickness no greater than 0.020 inch; decarburizing said steel to a carbon level below 0.005%; normalizing said steel at a temperature of from 1550° to 2000° F in a hydrogen-bearing atmosphere; applying a refractory oxide base coating to said steel; and final texture annealing said steel.

20 Claims, No Drawings

PROCESSING FOR CUBE-ON-EDGE ORIENTED SILICON STEEL

The present invention relates to an improvement in the manufacture of grain-oriented silicon steel.

Although U.S. Pat. Nos. 3,873,381, 3,905,842, 3,905,843 and 3,957,546 disclose somewhat dissimilar processing for producing boron inhibited electromagnetic silicon steel; they all specify a final normalize at a temperature of from 1475° to 1500° F. through this invention, I provide a process which improves upon those disclosed in the cited patents. Speaking broadly, I have found that the magnetic properties of boron-inhibited grain oriented silicon steels can be improved by normalizing cold rolled steel of final gage at a temperature of from 1550° to 2000° F. And as boron-inhibited silicon steels are characterized by processing and chemistries unlike those of other types of silicon steels, prior art disclosures of high temperature normalizes, such as those appearing in Belgian Pat. No. 833,649 and U.S. Pat. Nos. 3,159,511 and 3,438,820 are not significant.

It is accordingly an object of the present invention to provide an improvement in the manufacture of grain-oriented silicon steel.

In accordance with the present invention a melt of silicon steel containing from 0.02 to 0.06% carbon, from 0.0006 to 0.0080% boron, up to 0.0100% nitrogen, no more than 0.008% aluminum and from 2.5 to 4.0% silicon is subjected to the conventional steps of casting, hot rolling, one or more cold rollings to a thickness no greater than 0.020 inch, an intermediate normalize when two or more cold rollings are employed, decarburizing to a carbon level below 0.005%, application of a refractory oxide base coating, and final texture annealing; and to the improvement comprising the step of normalizing the cold rolled steel at a temperature of from 1550° to 2000° F in a hydrogen-bearing atmosphere. Specific processing, as to the conventional steps, is not critical and can be in accordance with that specified in any number of publications including U.S. Pat. No. 2,867,557 and the other patents cited hereinabove. Moreover, the term casting is intended to include continuous casting processes. A hot rolled band heat treatment is also includable within the scope of the present invention. It is, however, preferred to cold roll the steel to a thickness no greater than 0.020 inch, without an intermediate anneal between cold rolling passes; from a hot rolled band having a thickness of from about 0.050 to about 0.120 inch. Melts consisting essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, up to 1.0% copper, no more than 0.008% aluminum, balance iron, have proven to be particularly adaptable to the subject invention. Boron levels are usually in excess of 0.0008%. The refractory oxide base coating usually contains at least 50% MgO. Steel produced in accordance with the present invention has a permeability of at least 1870 ($G/O_e$) at 10 oersteds. Preferably, the steel has a permeability of at least 1890 ($G/O_e$) at 10 oersteds and a core loss of no more than 0.700 watts per pound at 17 kilogauss.

The steel is normalized at a temperture of from 1550° to 2000° F, and preferably from 1600° to 1900° F, to recrystallize the cold rolled steel. Heating to said temperature range usually occurs in a period of less than five, and even three, minutes. The hydrogen-bearing atmosphere can be one consisting essentially of hydrogen or one containing hydrogen admixed with nitrogen. A gas mixture containing 80% nitrogen and 20% hydrogen has been successfully employed. The dew point of the atmosphere is usually from −80° to +150° F, and generally between 0° and +110° F. Time at temperature is usually from 10 seconds to 10 minutes.

To promote further decarburization, the normalized steel may be maintained within a temperature range between 1400° and 1550° F, for a period of at least 30, and preferably, at least 60 seconds. This temperature range has been chosen as decarburization proceeds most effectively at a temperature of about 1475° F. Atmospheres for this treatment are as described hereinabove with regard to the 1550° to 2000° F normalize. Dew points are from +20° to +150° F, and generally between +40° and +110° F.

The following examples are illustrative of several aspects of the invention.

EXAMPLE I

Four samples (Samples A, B, C and D) of silicon steel were cast and processed into silicon steel having a cube-on-edge orientation from a heat of silicon steel. The chemistry of the heat appears hereinbelow in Table I.

TABLE I

| Composition (wt. %) | | | | | | | | |
|---|---|---|---|---|---|---|---|---|
| C | Mn | S | B | N | Si | Cu | Al | Fe |
| 0.043 | 0.035 | 0.020 | 0.0009 | 0.0049 | 3.24 | 0.34 | 0.004 | Bal. |

Processing for the samples involved soaking at an elevated temperature for several hours, hot rolling to a nominal gage of 0.080 inch, hot roll band normalizing at a temperature of approximately 1740° F, cold rolling to final gage, final normalizing as described hereinbelow, coating with a refractory oxide base coating and final texture annealing at a maximum temperature of 2150° F in hydrogen. Final normalizing conditions are set forth hereinbelow in Table II.

TABLE II

| Sample | Temperature (° F) | Atmosphere (%) | Dew Point (° F) | Time (Minutes) |
|---|---|---|---|---|
| A* | 1475 | 80N - 20H | + 50 | 2 |
| B** | 1600 | 80N - 20H | + 50 | 5 |
| C** | 1800 | 80N - 20H | + 50 | 5 |
| D** | 1900 | 80N - 20H | + 50 | 5 |

*Heating Time - more than 5 minutes to temperature
**Heating Time - approximately two minutes to temperature Samples A through D were tested for permeability and core loss. The results of the tests appear hereinbelow in Table III.

TABLE III

| Sample | Core Loss (WPP at 17 KB) | Permeability (at 10 $O_e$) |
|---|---|---|
| A | 0.753 | 1856 |
| B | 0.631 | 1925 |
| C | 0.626 | 1927 |
| D | 0.635 | 1930 |

From Table III, it is clear that the processing of the present invention is highly beneficial to the properties of silicon steel having a cube-on-edge orientation. An improvement is seen in both core loss and permeability when the cold rolled steel is normalized at a temperature in excess of 1550° F. Sample A normalized at 1475° F had a permeability of 1856 ($G/O_e$) at 10 oersteds whereas Samples B, C and D which were normalized at respective temperatures of 1600, 1800 and 1900° F all had permeabilities in excess of 1900 ($G/O_e$) at 10 oersteds. Similarly, Samples B, C and D all had a core loss of less than 0.700 watts per pound at 17 kilogauss, whereas the core loss of Sample A was 0.753 watts per pound at 17 kilogauss.

EXAMPLE II

Six additional samples (Samples E, F, G, H, I and J) of silicon steel were cast and processed into silicon steel having a cube-on-edge orientation from the heat of silicon steel described hereinabove in Table I. Processing for the samples involved soaking at an elevated temperature for several hours, hot rolling to a nominal gage of 0.080 inch, hot roll band normalizing at a temperature of approximately 1740° F, cold rolling to final gage, final normalizing as described hereinbelow, coating with a refractory oxide base coating and final texture annealing at a maximum temperature of 2150° F in hydrogen. Final normalizing conditions are set forth hereinbelow in Table IV. As noted therein, Samples F, G, H, I and J received a duplex normalize. The carbon content of all the samples was less than 0.005% after normalizing. Normalizing occurred in an 80% $N_2$-20% $H_2$ atmosphere.

TABLE IV

| | First Normalize | | | Second Normalize | | |
|---|---|---|---|---|---|---|
| Sample | Temp. (° F) | Dew Point (° F) | Time (Mins.) | Temp. (° F) | Dew Point (° F) | Time (Mins.) |
| E | 1475* | + 50 | 2 | | | |
| F | 1600** | + 50 | 5 | 1475* | + 50 | 2 |
| G | 1800** | + 50 | 2 | 1475* | + 50 | 2 |
| H | 1800** | + 50 | 2 | 1475* | + 80 | 2 |
| I | 1800** | + 50 | 5 | 1475* | + 50 | 2 |
| J | 1800** | + 50 | 5 | 1475* | + 80 | 2 |

*Heating Time - more than 5 minutes to temperature
**Heating Time - approximately 2 minutes to temperature Samples E through J were tested for permeability and core loss. The results of the tests appear hereinbelow in Table V.

TABLE V

| Sample | Core Loss (WPP at 17 KB) | Permeability (at $100_e$) |
|---|---|---|
| E | 0.744 | 1856 |
| F | 0.671 | 1899 |
| G | 0.676 | 1917 |
| H | 0.653 | 1896 |
| I | 0.667 | 1914 |
| J | 0.672 | 1904 |

From Table V, it is once again clear that the processing of the present invention is highly beneficial to the properties of silicon steel having a cube-on-edge orientation. An improvement is seen in both core loss and permeability when the cold rolled steel is normalized at a temperature in excess of 1550° F. Sample E normalized at 1475° F had a permeability pf 1856 ($G/O_e$) at 10 oersteds whereas Samples F through J which were normalized at temperatures of 1600° and 1800° F all had permeabilities in excess of 1890 ($G/O_e$) at 10 oersteds. Similarly, Samples F through J all had a core loss of less than 0.700 watts per pound at 17 kilogauss, whereas the core loss of Sample E was 0.744 watts per pound at 17 kilogauss. The 1475° F renormalize promoted decarburization; but as evident from a comparison of Tables II and III on the one hand, and IV and V on the other, caused some deterioration in properties. As noted hereinabove a renormalize at a temperature between 1400° and 1550° F is included within certain embodiments of the subject invention insofar as decarburization proceeds most effectively at temperatures of about 1475° F.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing electromagnetic silicon steel having a cube-on-edge orientation and a permeability of at least 1870 ($G/O_e$) at 10 oersteds, which process includes the steps of: preparing a melt of silicon steel containing from 0.02 to 0.06% carbon, from 0.015 to 0.15% manganese, from 0.01 to 0.05% of material from the group consisting of sulfur and selenium, from 0.0006 to 0.0080% boron, up to 0.0100% nitrogen, up to 1.0% copper, no more than 0.008% aluminum and from 2.5 to 4.0% silicon; casting said steel; hot rolling said steel; cold rolling said steel to a final gage no greater than 0.020 inch; normalizing said steel; decarburizing said steel to a carbon level below 0.005%; applying a refractory oxide base coating to said steel; and final texture annealing said steel; the improvement comprising the step of normalizing said cold rolled steel of final gage at a temperature of from 1550° to 2000° F in a hydrogen-bearing atmosphere, so as to recrystallize the cold rolled steel; and subsequently applying said refractory oxide base coating to said steel; said processed steel having a permeability of at least 1870 ($G/O_e$) at 10 oersteds; said normalize at a temperature of from 1550° to 2000° F contributing to the high permeability of said steel.

2. The improvement according to claim 1, wherein said melt has at least 0.0008% boron.

3. The improvement according to claim 2, wherein said cold rolled steel is normalized at a temperature of from 1600° to 1900° F.

4. The improvement according to claim 2, wherein said cold rolled steel is heated to a temperature within said normalizing temperature range in a period of less than five minutes.

5. The improvement according to claim 4, wherein said period is less than three minutes.

6. The improvement according to claim 2, wherein said hydrogen-bearing atmosphere has a dew point of from −80° to +150° F.

7. The improvement according to claim 2, wherein said hydrogen-bearing atmosphere has a dew point of from 0° to +110° F.

8. The improvement according to claim 7, wherein said hydrogen-bearing atmosphere consists essentially of hydrogen and nitrogen.

9. The improvement according to claim 2, wherein said normalized steel is maintained in a hydrogen-bearing atmosphere for a period of at least 30 seconds within a temperature range between 1400° and 1550° F, to promote the decarburization of said steel.

10. The improvement according to claim 9, wherein said period is at least 1 minute.

11. The improvement according to claim 9, wherein said normalized steel is maintained in a hydrogen-bearing atmosphere having a dew point of from +20° to +150° F at said temperature range between 1400° and 1550° F.

12. The improvement according to claim 11, wherein said normalized steel is maintained in a hydrogen-bearing atmosphere having a dew point of from +40° to +110° F at said temperature range between 1400° and 1550° F.

13. The improvement according to claim 12, wherein said normalized steel is maintained in a hydrogen-bearing atmosphere consisting essentially of hydrogen and nitrogen at said temperature range between 1400° and 1550° F.

14. The improvement according to claim 2, wherein said cold rolled steel is normalized at a temperature of from 1600° to 1900° F in a hydrogen-bearing atmosphere having a dew point of from 0° to +110° F, and subsequently maintained in a hydrogen-bearing atmosphere having a dew point of from +40° to +110° F for a period of at least 30 seconds within a temperature range between 1400° and 1550° F.

15. The improvement according to claim 2, wherein said hot rolled steel has a thickness of from 0.050 to about 0.120 inch and wherein said hot rolled steel is cold rolled to a thickness of no more than 0.020 inch without an intermediate anneal between cold rolling passes.

16. The improvement according to claim 1, wherein said melt consists essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, up to 1.0% copper, no more than 0.008% aluminum, balance iron.

17. The improvement according to claim 16, wherein said melt has at least 0.0008% boron.

18. The improvement according to claim 1, wherein said oriented silicon steel has a permeability of at least 1890 ($G/O_e$) at 10 oersteds and a core loss of no more than 0.700 watts per pound at 17 kilogauss.

19. A cube-on-edge oriented silicon steel having a permeability of at least 1870 ($G/O_e$) at 10 oersteds, and made in accordance with the process of claim 2.

20. The improvement according to claim 2, wherein said normalize at a temperature of from 1550° to 2000° F is for a period of from ten seconds to ten minutes.

* * * * *